US005442869A

United States Patent [19]

McDarren et al.

[11] Patent Number: 5,442,869

[45] Date of Patent: Aug. 22, 1995

[54] ANIMATED CRYSTAL BALL OR GLOBE DISPLAY SYSTEM

[75] Inventors: Deborah J. McDarren, Ridgefield; James Dahl, Danbury, both of Conn.

[73] Assignee: Link Group International, Ridgefield, Conn.

[21] Appl. No.: 195,870

[22] Filed: Feb. 14, 1994

[51] Int. Cl.[6] ..... G09F 19/08

[52] U.S. Cl. ..... 40/406; 40/410; 40/411; 446/358

[58] Field of Search ..... 40/406, 409, 410, 411, 40/414, 418; 446/358, 297, 303, 241

[56] References Cited

U.S. PATENT DOCUMENTS

| | | | |
|---|---|---|---|
| 4,641,445 | 2/1987 | Rossi | 40/410 |
| 4,852,283 | 8/1989 | Teng | 40/410 X |
| 4,961,276 | 10/1990 | Lin | 40/410 |
| 5,018,288 | 5/1991 | Yang | 40/411 X |
| 5,070,633 | 12/1991 | Liu | 40/411 |
| 5,110,636 | 5/1992 | Hou | 40/410 X |
| 5,131,175 | 7/1992 | Liu | 40/410 |
| 5,261,848 | 11/1993 | Kaplan et al. | 40/410 X |
| 5,338,583 | 8/1994 | Hou | 40/411 X |

*Primary Examiner*—Brian K. Green
*Assistant Examiner*—James O. Hansen
*Attorney, Agent, or Firm*—Melvin I. Stoltz

[57] ABSTRACT

A unique, visually exciting, fully animated crystal ball or globe display system is attained by providing a dual chamber globe assembly, with one chamber substantially peripherally surrounding the second chamber and incorporating any desired fluid therein. With the animated scene in the second chamber, the resulting crystal ball or globe display system provides the visual impression of being fully animated and fluid-filled. In the preferred embodiment, the fluid comprises any desired liquid and contains particles therein for further visual enhancement. In addition, the liquid and particles are continuously recirculated throughout the chamber to enable both the liquid and particles to be continuously swirling, thereby providing additional visual enhancements and entertainment.

20 Claims, 5 Drawing Sheets

ANIMATED CRYSTAL BALL OR GLOBE DISPLAY SYSTEM

TECHNICAL FIELD

This invention relates to crystal ball or globe display systems and, more particularly, to such display systems containing animated characters, scenes, music or are liquid filled.

BACKGROUND ART

Substantial interest has long been given by the public to visually or audibly pleasing or exciting display systems. These systems typically include musical and/or animated figures or characters mounted within a transparent crystal ball or globe.

Another group of display systems that have long been enjoyed by the consuming public are transparent crystal balls or globes filled with liquid, within which are contained particular scenes or objects. Although a movable component may be incorporated in the scene or object, these liquid-filled display systems are incapable of incorporating animated characters or objects, as is commonly found in non-liquid bearing crystal balls or globe display systems.

Although the liquid-filled globe or crystal ball display systems may incorporate means for playing a particular musical tune, most of the liquid-filled displays also incorporate visually distinctive particles contained in the liquid which are capable of being stirred by twisting or rotating the display in its entirety. Typically, these particles comprise glitter, confetti, or white, snowflake-like material and provide additional visual stimulation as the particles fall through the liquid by gravity. Once all of the particles are completely deposited on the base, due to the pull of gravity, the process can be repeated by lifting or shaking the globe to redisperse the particles throughout the liquid.

Although both types of crystal ball or globe display systems are extremely popular, prior art systems have been incapable of combining a liquid-filled globe or crystal ball display system with animated characters and/or objects. Due to unavoidable adverse interaction between the liquid and the mechanical and/or electrical components, animated characters or animated scenes have been incapable of being provided in combination with a liquid-filled crystal ball or globe display system.

The only advance that has been made in this area by prior art systems is the ability to incorporate means for providing music along with a liquid display by sealing the music producing assembly in the base of the display. In this way, the liquid contained within the crystal ball or globe is maintained completely separate from the music-producing means, thereby enabling musical backgrounds to be associated with liquid-filled crystal ball or globe displays.

Therefore, it is a principal object of the present invention to provide a crystal ball or globe display system which is capable of providing fully animated figures, characters, and/or objects while also providing in combination therewith the visual appearance of a liquid-filled display system.

Another object of the present invention is to provide a crystal ball or globe display system having the characteristic features described above which is capable of providing background music whenever desired.

Another object of the present invention is to provide a crystal ball or globe display system having the characteristic features described above which is capable of being automatically activated by the movement of individuals approaching the display system.

Another object of the present invention is to provide a crystal ball or globe display system having the characteristic features described above which incorporates activation means for continuously providing swirling particulate matter throughout the liquid, while producing the visual impression of snow or particles failing whenever the system is activated.

Other and more specific objects will in part be obvious and will in part appear hereinafter.

SUMMARY OF THE INVENTION

By employing the present invention, all of the prior art limitations and inabilities are completely overcome and a crystal ball or globe display system is attained which is capable of providing both animated figures, characters, and/or objects which are fully movable, whenever desired, in a display which is completely surrounded by any desired fluid. In this way, a display system is attained which visually provides a liquid-filled, fully animated crystal ball or globe display system.

Preferably, particulate matter is also incorporated in the liquid and is capable of being manually or automatically dispensed throughout the liquid medium, whenever desired. In addition, if desired, music is also incorporated into the crystal ball or globe display system of the present invention, in order to provide further enhancements and enjoyment.

In the present invention, the prior art failure to attain an animated crystal ball or globe display system combined with a liquid filled system is completely overcome by providing a crystal ball or globe display system with a dual-zone chamber. In its preferred embodiment, the dual-zone chamber of the present invention comprises a first interior chamber, which contains the animated display, and a second sealed chamber peripherally surrounding the first chamber. The desired liquid or other fluid medium and particulate matter, if desired, are sealed within the second chamber.

By employing this construction, the animated characters and the requisite mechanisms associated therewith are capable of being easily positioned within the first chamber while the liquid medium and particulate matter are sealed in the separate and independent second chamber. In this way, a display system is provided which visually achieves a liquid-filled animated display system.

By employing the present invention, completely animated crystal ball or globe display systems are provided, while also providing the visual appearance of the display systems being liquid-filled with falling snow, glitter, confetti, or other particulate matter, if desired. As a result, the visual appearance of the display system of the present invention is substantially enhanced, providing a visually exciting display system combining features which had previously been unobtainable.

Although the dual chamber crystal ball/globe assembly of the present invention can be constructed in numerous ways, the preferred construction comprises the use of two separate globe members having different sizes or diameters, which are concentrically mounted with each other, in juxtaposed, spaced, cooperating relationship. In this way, the desired dual chamber system is attained.

In order to further enhance the visual appearance of the crystal ball or globe display system of the present invention, the fluid filled second chamber established between the facing walls of the globe members is connected to a pump system which is capable of continuously circulating the fluid retained in the second chamber. In addition, in the preferred embodiment, the desired particulate matter is also contained in the fluid medium.

By employing a pump system for circulating the fluid medium and particulate matter, the present invention automatically, continuously recirculates the fluid medium, causing the particulate matter contained therein to be constantly swirled throughout the interior chamber, providing the continuous visual impression of falling snow or particles. As a result, manual activation by shaking or rotating the display system is eliminated.

As a further enhancement of the crystal ball or globe display system of the present invention, the pump assembly is preferably powered by battery means mounted in association therewith with switch means connected between the power source and the pump assembly to enable the pump to be activated or deactivated whenever desired. In addition, in the preferred construction, the switch means comprises a light sensitive or motion sensitive photocell which is activated by conventional lighting or movement of individuals approaching the display system.

In this preferred construction, whenever activation has occurred, such as by movement or presence of an individual or the turning on of a light, the fluid circulating pump is automatically activated, causing the swirling particles to be continuously in motion. In addition, if desired, the drive system for creating the animation of the characters contained within the display system as well as the music is also automatically activated, thereby automatically initiating all of the desired movement, motion and sound required for providing the desired high level entertainment for the display system of the present invention.

The invention accordingly comprises the features of construction, combination of elements and arrangement of parts which will be exemplified in the construction hereinafter set forth and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
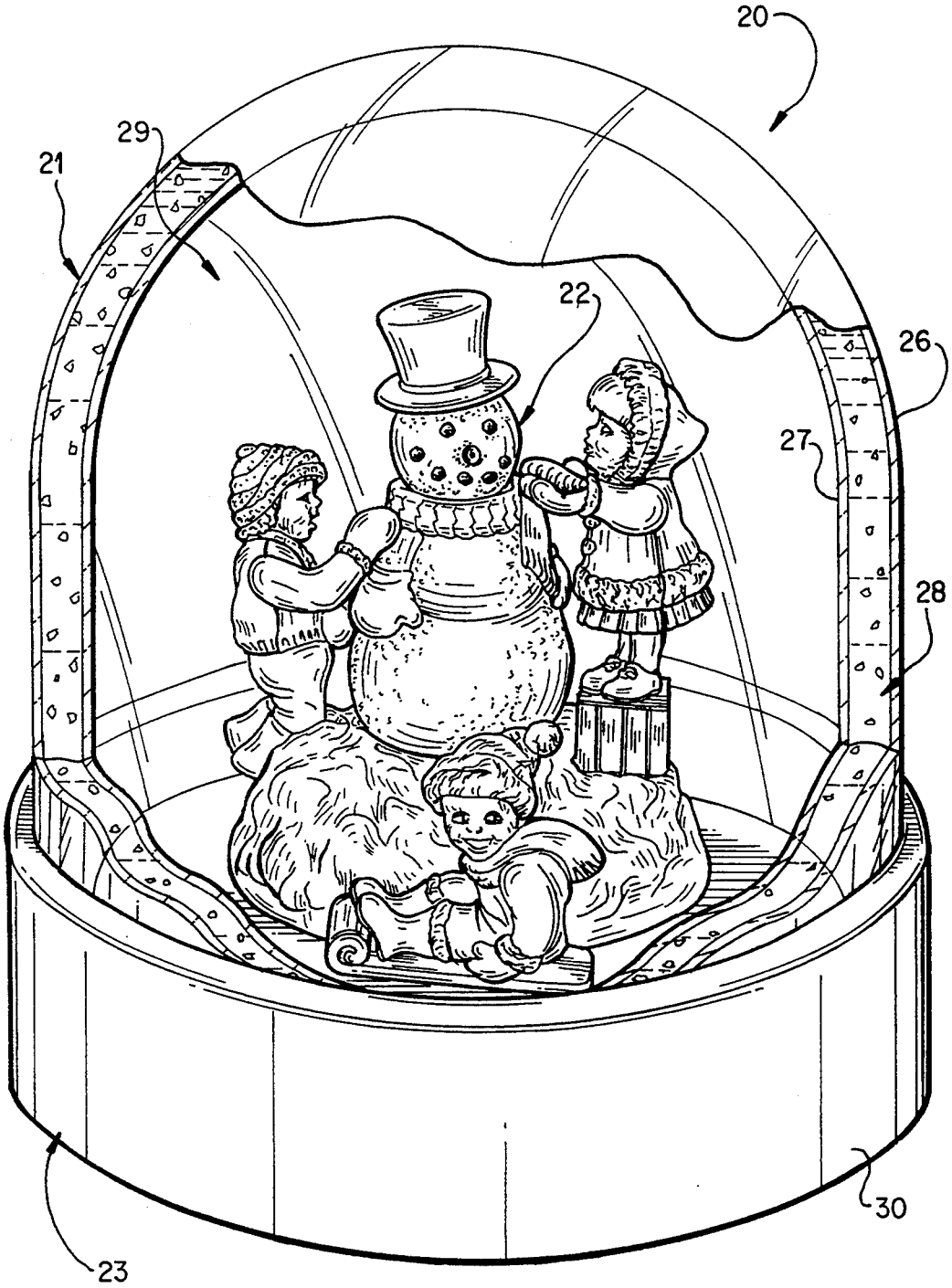
FIG 1 is a perspective view of a fully assembled crystal ball or globe system made in accordance with the present invention.

By referring to FIGS. 1–6, along with the following detailed disclosure, the construction and operation of the crystal ball or globe display system 20 of the present invention can best be understood. In the drawings and this disclosure, one particular animated scene is depicted and discussed. However, it is understood that the present invention is not in any way intended to be limited to any particular animated scene and that the present invention can be employed with any animated figures, objects, musical score, etc., without departing from the scope of the present invention.

Figure 2:
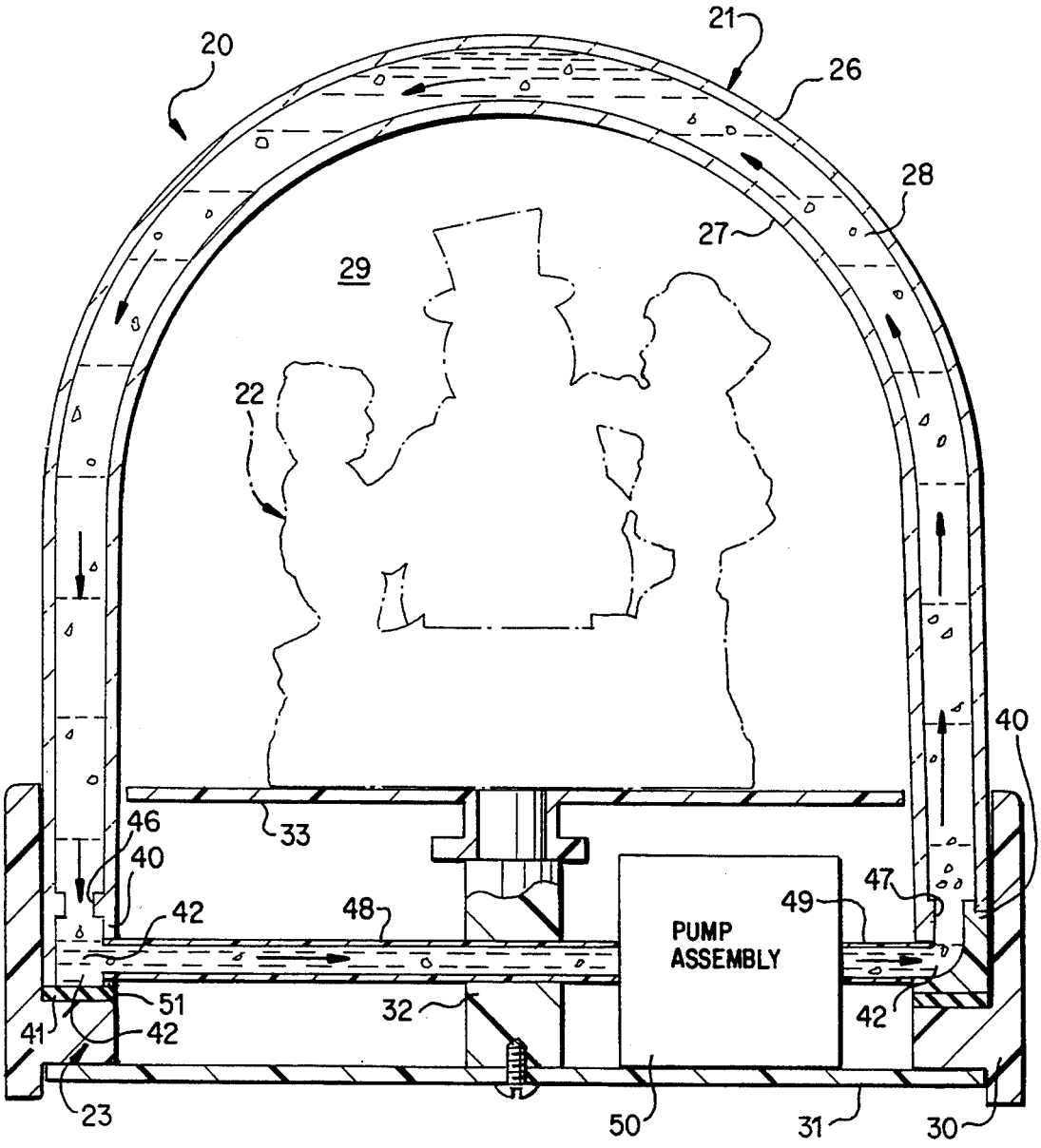
FIG. 2 is a cross-sectional side elevation view, partially in phantom, of the crystal ball or globe display system of FIG. 1.

As shown in FIGS. 1 and 2, crystal ball or globe display system 20 of the present invention comprises a transparent crystal ball or globe assembly 21 which peripherally surrounds and envelopes a visually pleasing and distinctive scene 22. As depicted in FIG. 1, scene 22 comprises two children positioned on a mound of snow in the process of building a snowman, with a third child riding a sled about the snow mound. In accordance with this invention, scene 22 is fully animated, with the snowman's head and body being movable, along with one or more arms of each of the two children also being constructed for movement, depicting the children completing the formation of the snowman. In addition, in this embodiment, the child on the sled continuously rotates about the snow mound to provide continuous action. In addition, music-producing means is also preferably incorporated to enhance the entertainment provided.

As discussed above, scene 22 is shown herein as one example of the plurality of animated scenes that can be employed. In accordance with this invention, any desired characters, objects, or figures can be employed with any desired level of animation incorporated therein.

In accordance with the present invention, scene 22 and the means for animating scene 22 all comprise state of the art technology and, are well known to those having ordinary skill in this art. Consequently, detailed discussion of the construction and operation for animating scene 22 is not provided and is not shown in the drawings.

Figure 3:
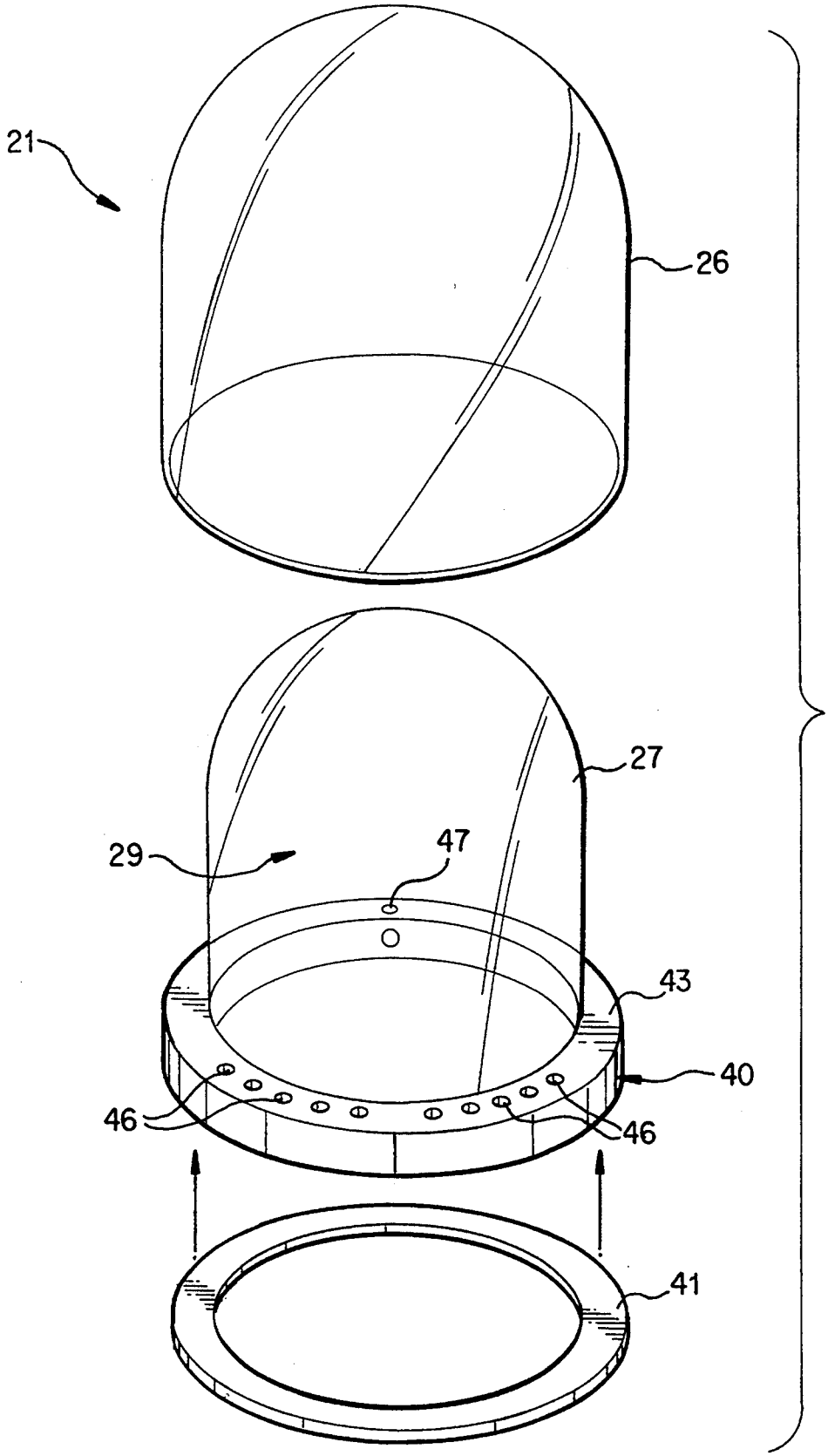
FIG. 3 is an exploded perspective view of the dual globe member assembly of the present invention which forms a part of the crystal ball or globe display system.
Figure 4:
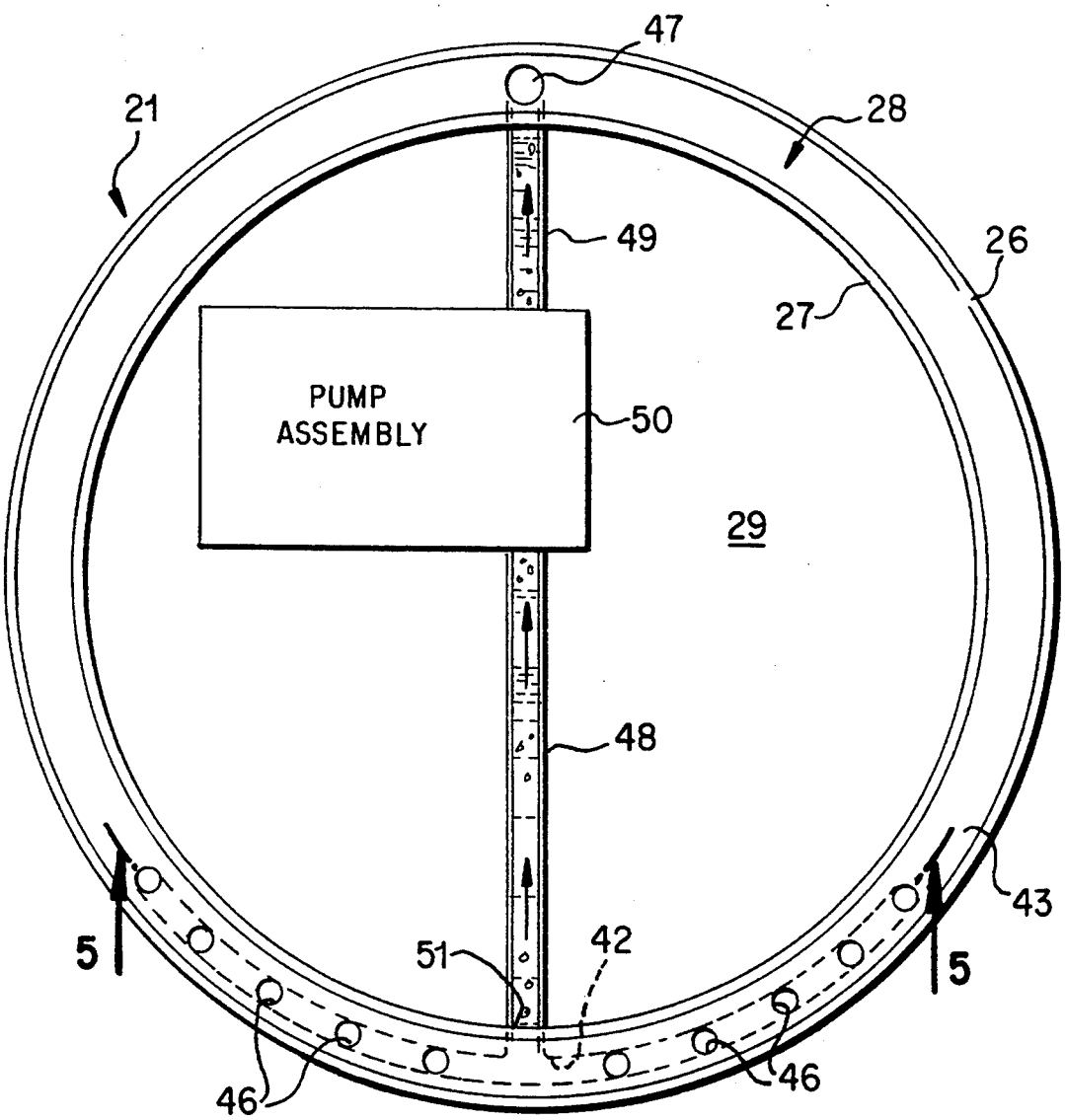
FIG. 4 is a top plan view of the dual globe member assembly of the present invention.
Figure 5:
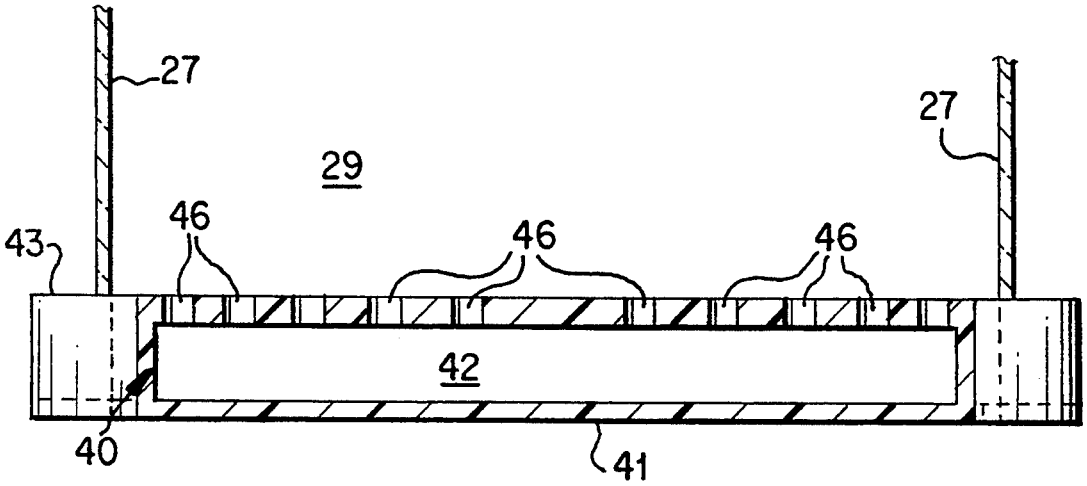
FIG. 5 is a cross-sectional side elevational view of a portion of the dual globe member assembly of the present invention taken along line 5—5 of FIG. 4.

As best seen in FIGS. 1–3, the unique achievement of the present invention is attained in the preferred embodiment by constructing crystal ball/globe assembly 21 with two separate and independent globe members 26 and 27. Globe members 26 and 27 are constructed with substantially identical shapes with different dimensions. In this way, globe members 26 and 27 can be placed in juxtaposed, spaced, concentrically aligned, cooperating relationship with each other. Using this construction, chamber 28 is formed between the walls of globe member 26 and 27, while chamber 29 is formed inside globe member 27. In addition, the adjacent terminating ends of globe members 26 and 27 are integrally sealed together to form chamber 28 as a fully enclosed, sealed, fluid-holding chamber.

By constructing globe assembly 21 in the manner detailed above, fluid-holding chamber 28 is created and is capable of retaining any desired fluid therein for circulation therethrough. In addition, as detailed below, particulate matter is preferably incorporated in the fluid to add a further visual enhancement to display system 20.

When circulated throughout chamber 28, as detailed below, the flowing fluid and particulate matter create a visual impression that the entire crystal ball/globe display member 20 is completely filled with fluid. Consequently, when completely assembled, crystal ball or globe display member 20 provides the visual impression of having fully and completely animated characters capable of performing their animated activities in a completely fluid filled environment. As a result, the prior art inabilities are completely overcome.

As stated above, in addition to forming fluid holding chamber 28 between the juxtaposed, spaced, cooperating walls of globe members 26 and 27, chamber 29 is established by the interior wall of globe member 27. Chamber 29 is air-filled and forms the interior chamber within which animated scene 22 is enclosed and retained. With globe assembly 21 fully assembled and positioned peripherally surrounding animated scene 22 and engaged with supporting base 23, crystal ball or globe display system 20 is completed, ready to provide the desired visual effect.

As best seen in FIG. 2, supporting base 23 comprises side panel 30, cover plate 31, support post 32, and scene support platform 33. Also incorporated in support base 23 is the mechanism for controlling the desired animation of scene 22 as well as the music generating means. However, these elements are not shown in the figures, since their construction is well-known and is not part of the present invention.

By referring to FIGS. 1–5, along with the following detailed disclosure, the construction of globe assembly 21 of the present invention can best be understood. In the preferred embodiment, globe members 26 and 27 comprise substantially identical shapes, differing only in their respective diameters. In this way, globe members 26 and 27 are capable of being telescopically aligned in overlying, juxtaposed, spaced, concentric interengaged relationship with each other.

As shown throughout the drawings, globe members 26 and 27 each comprise a cylindrical portion and an integrally formed hemispherical portion, resulting in a generally conventional bell-jar configuration. Although this construction is preferred, globe members 26 and 27 can be formed in any desired shape or configuration. Furthermore, identity of shape and configuration between globe members 26 and 27 is not mandatory.

The principal requirement in accordance with the teaching of the present invention is to form globe members 26 and 27 in a manner which enables the globe members to be positioned in cooperating relationship with each other, establishing a fluid holding chamber 28 between the adjacent walls thereof and an interior chamber 29. Interior chamber 29 is preferably employed for receiving the desired visual display 22, with fluid holding chamber 28 peripherally surrounding display 22 and chamber 29.

In the preferred construction, in order to maintain globe members 26 and 27 spaced apart the desired distance for establishing fluid holding chamber 28 and enabling chamber 28 to be capable of enabling any desired fluid to be circulated therein, without leaking, globe assembly 21 incorporates annular collar 40 and sealing ring 41. Depending on the construction desired, annular collar 40 is formed as a separate component or formed integrally with globe member 27. Regardless of which manufacturing construction is employed, annular collar 40 is positioned in cooperating association with the open end of globe member 27 effectively peripherally surrounding and being sealingly engaged or integrally formed with the terminating end of globe member 27.

If two separate components are employed, the inner surface of annular ring 40 can be constructed to peripherally surround the outer surface of globe member 27 and be sealingly affixed to the outer surface of globe member 27, directly adjacent the open end thereof. Alternatively, the terminating end of globe member 27 can be sealingly affixed to top surface 43 of annular ring 40. Regardless of which construction is employed, a secure, fluid containing, sealed interengagement of globe member 27 to annular collar 40 is obtained.

In its preferred construction, annular collar 40 comprises a fluid flow controlling channel 42 which extends along annular collar 40 through an arc of between about 90° and 135°. In the preferred construction, channel 42 is open at the base of collar 40, with ring 41 being employed for cooperating, mounted interengagement with collar 40 at the base thereof, securely sealing channel 42 to prevent any unwanted fluid leakage therefrom.

Annular collar 40 also incorporates a plurality of chamber outlet portals 46 formed in top surface 43 thereof, spaced along an elongated portion of top surface 43 and extending into channel 42, providing fluid flow communication therewith. In addition, at a substantially diametrically opposed location on top surface 43 of collar 40 at least one chamber inlet portal 47 is formed, extending from the inside surface of collar 40 to top surface 43 thereof.

Globe assembly 21 is completed by incorporating flow tubes 48 and 49, along with flow controlling pump assembly 50. In the preferred construction, one end of flow tube 48 is mounted in portal 51, which is formed in the inner wall of annular collar 40 extending into channel 42. The opposed end of tube 48 is mounted in pump assembly 50. How tube 49 has one end mounted in the outlet portal of pump assembly 50, with the opposed end of tube 49 securely affixed within portal 47 of collar 40.

As is more fully detailed below, pump assembly 50 incorporates a fluid flow controlling pump, which is connected to a power source and switch means for activating the pump whenever desired. Once activated, pump assembly 50 provides a desired continuous flow of the fluid contained within chamber 48.

By employing the construction detailed above, the fluid contained within chamber 48 flows throughout chamber 28, while being continuously drawn through the plurality of chamber outlet portals 46. Once the fluid flows through chamber outlet portals 46, the fluid enters channel 42 and is drawn through tube 48 to pump assembly 50. Pump assembly 50 then continues to recirculate the fluid, forcing the fluid out of the pump through tube 49 and directly into chamber inlet portal or passageway 47. Once the fluid exits passageway 47, the fluid enters chamber 28 for repeating the circulation cycle.

As is evident from the foregoing disclosure, the fluid contained within chamber 28 continuously circulates throughout chamber 28 whenever pump assembly 50 has been activated. In addition to the continuous flow of the fluid therethrough, the preferred embodiment of the present invention incorporates particulate matter within the fluid in order to add the desired visual effect of snow-like particles, glitter, confetti, or any other desired visual enhancement. By controlling the size and dimension of the particles employed, free, non-clogging flow of both the fluid and the particles are assured and the desired visual effect of a conventional liquid-filled, particle containing display system is attained.

Preferably, the fluid employed in the present invention comprises a liquid selected from the group consisting of glycol, glycerin, and water. When water is employed, the water preferably comprises distilled water, or bacteria-free water.

In addition to the desired fluid being circulated through chamber 28, visually stimulating particles, such as snow-like particles, confetti, and/or glitter are incorporated within the fluid for adding visual impact thereto. Although any desired particles can be employed, particles having a specific gravity close to water are preferred for providing the desired visual effect. In this regard, particles formed from ABS plastic styrene, mylar and acrylic may be employed. In addition, in the present invention, it has been found that spherically-shaped particles or square-shaped particles are preferred in order to assure continuous free fluid flow, without clogging. In this regard, the particles preferably comprise a central diameter or length ranging between about 0.04 to 0.08 inches.

In order to provide the desired visual effect of a liquid-filled crystal ball or globe display member within which a fully animated, musical display assembly is contained, the dual-chambered globe assembly detailed above is employed. By employing the combination of globe assembly 21 of the present invention with an otherwise conventional animated scene, the previously unattainable visual effect of a liquid-filled animated display member is realized.

Figure 6:
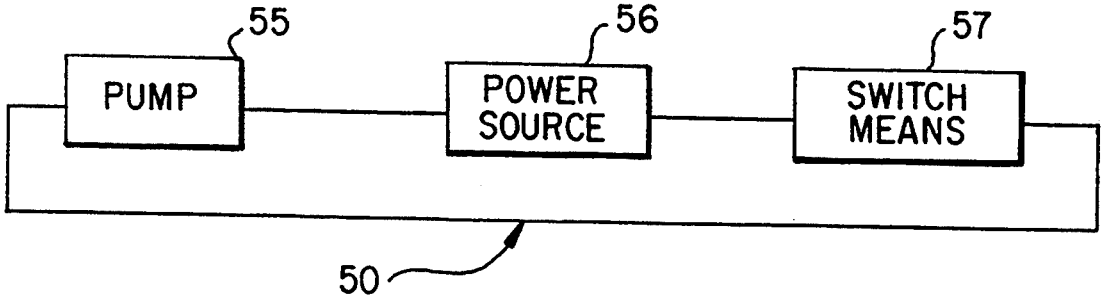
FIG. 6 is a schematic functional block diagram of the pump assembly employed in the crystal ball or globe display system of the present invention.

In order to provide continuous, long-lasting enjoyment of crystal ball or globe display system 20 of the present invention in a construction that is economically manufactured and produced, pump assembly 50 employs the overall circuit construction shown in FIG. 6. In this construction, pump 55 preferably comprises a conventional liquid flow controlling pump, which continuously circulates any desired liquid therethrough, drawing the liquid into an inlet portal and forcing the liquid out of its outlet portal. In order to maintain pump 55 continuously operating, pump 55 is connected to a power source 56. Depending upon the type of power desired, power source 56 may comprise household current or, if preferred, comprises batteries which are contained within base 23.

In order to activate pump 55, switch means 57 are mounted between pump 55 and power source 56. Switch means 57 may comprise any desired conventional switch assembly, ranging from a simple manual switch, activated by the consumer whenever desired, to more sophisticated automatically activated switches, responsive to motion, light, etc.

By employing automatic activation switch means, such as motion detectors, pump 55 can be automatically activated whenever any movement is detected by switch means 57, such as produced when an individual approaches display system 20. Once activated, the system can continue to operate until motion is no longer detected or, alternatively, remains active for a predefined period of time and then automatically turns off. In this way, economical and more exciting and enhanced use and enjoyment of display system 20 is realized.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described our invention, what we claim is new and desire to secure by Letters Patent is:

1. A crystal ball or globe display system comprising
- A. a support base;
- B. a display mounted to the support base;
- C. a globe assembly mounted to the support base and comprising
  - a. a first member peripherally surrounding the display,
  - b. a second member peripherally surrounding a substantial portion of the first member and defining a space filled with a fluid between the two members, thereby providing the visual effect of the display being contained within the fluid, and
  - c. first and second aperture means cooperatively associated with the space defined between the two members for enabling the fluid to be circulated into and out of the space and
- D. pump means
  - a. cooperatively associated with the first and second aperture means of the globe assembly, and
  - b. responsive to an activation signal for continuously circulating the fluid through the second zone when activated;

whereby a crystal ball or globe display system is attained which appears to have the display contained in a fluid filled globe.

2. A crystal ball or globe display system comprising
- A. a support base;
- B. a display mounted on the support base and incorporating at least one object which is movable in response to an activation signal providing visual interest and enhancement to the visual display;
- C. a globe assembly peripherally surrounding the display, said globe assembly comprising
  - a. a first chamber comprising an enlarged space constructed for retaining the display and movable object, and
  - b. a second chamber peripherally surrounding and substantially enveloping a substantial portion of the first chamber, said second chamber being constructed for retaining a fluid between the first and second chambers, providing the visual effect of the display being fully contained in the fluid; and
- D. drive means
  - a. mounted in the base,
  - b. connected to the movable object for controlling the movement thereof, and
  - c. responsive to an activation signal for initiating the operation of the drive means;

whereby a crystal ball or globe display system is attained which is capable of providing the visual impression of a display having a movable object contained in a fluid-filled housing.

3. The crystal ball or globe display system defined in claim 1, wherein said globe assembly is further defined as comprising a transparent liquid sealed within the space defined between the two members in a manner requiring the viewing of the display through the liquid.

4. The crystal ball or globe display system defined in claim 3, wherein said liquid is further defined as comprising one selected from the group consisting of glycerin, glycol, distilled water, and bacteria-free water.

5. The crystal ball or globe display system defined in claim 2, wherein said globe assembly is further defined as comprising c. a first globe member having a wall forming an interior space establishing the first chamber, and d. a second globe member constructed for peripherally surrounding the first globe member in juxtaposed, spaced, substantially coaxially aligned relationship therewith, defining the second chamber as the space between the first globe member and the second globe member.

6. The crystal ball or globe display system defined in claim 5, wherein said first globe member and said second globe member are further defined as comprising substantially bell-jar configurations with different diameters, with said second globe member having a diameter greater than the diameter of the first globe member for peripherally surrounding and being in coaxial aligned interengagement with said first globe member.

7. The crystal ball or globe display system defined in claim 6, wherein said globe assembly further comprises e. an annular collar sealingly mounted to the first globe member and the second globe member for securely retaining the globe members in juxtaposed, spaced, cooperating relationship with each other while establishing the second chamber as a sealed fluid-retaining space.

8. The crystal ball or globe display system defined in claim 2, wherein said second chamber is further defined as being sealed for retaining the fluid contained therein and incorporating a first portal and a second portal formed substantially diametrically opposed from the first portal for enabling the fluid contained in the second chamber to be circulated therethrough.

9. The crystal ball or globe display system defined in claim 8, wherein said system further comprises E. a pump assembly connected between the first portal and the second portal for drawing the fluid from the second chamber through the first portal and recirculating the fluid into the second chamber through the second portal after passage through said pump assembly, whereby continuously circulating fluid is provided for further enhancing the display thereof.

10. The crystal ball or globe display system defined in claim 9, wherein said fluid is further defined as incorporating particulate matter for providing further visual enhancement thereto.

11. The crystal ball or globe display system defined in claim 10, wherein said particulate matter is further defined as comprising one selected from the group consisting of snow-like particles, glitter, and confetti.

12. The crystal ball or globe display system defined in claim 11, wherein said particulate matter is further defined as being formed from one selected from the group consisting of ABS plastic, styrene, mylar and acrylic.

13. The crystal ball or globe display system defined in claim 9, wherein said first portal is further defined as comprising a plurality of portal members formed in the annular collar extending along an arc ranging between about 90° and 135°, with said first portal forming a fluid outlet space for the second chamber.

14. The crystal ball or globe display system defined in claim 13, wherein said second portal is further defined as comprising a single passageway formed in the annular collar for providing a fluid inlet to the second chamber.

15. The crystal ball or globe display system defined in claim 14, wherein said fluid is further defined as comprising a liquid and said pump assembly is further defined as comprising a. a liquid flow-controlling pump, b. a power source for maintaining the pump operational whenever desired, and c. switch means mounted between the pump and the power source for controlling the activation and de-activation of the pump.

16. The crystal ball or globe display system defined in claim 15, wherein said power source is further defined as comprising one selected from the group consisting of conventional household current and battery power.

17. The crystal ball or globe display system defined in claim 15, wherein said switch means is further defined as comprising one selected from the group consisting of manual switches, photocells, and motion sensors.

18. The crystal ball or globe display system defined in claim 15, wherein said system is further defined as comprising timer means for controlling the operation of the pump for a predefined period of time and thereafter automatically shutting the pump off.

19. The crystal ball or globe display system defined in claim 2, wherein said system further comprises D. music-producing means contained within the support base for automatically producing an audible music accompaniment to the display upon activation.

20. A crystal ball or globe display system comprising

A. a support base;

B. a display mounted on the support base and incorporating at least one object which is movable in response to an activation signal providing visual interest and enhancement to the visual display;

C. a globe assembly mounted to the support base and comprising a. a first member peripherally surrounding the display, b. a second member peripherally surrounding a substantial portion of the first member and defining a space filled with a liquid between the two members, thereby providing the visual effect of the display being contained within the fluid, and c. first and second aperture means cooperatively associated with space defined between the two members zone for enabling the fluid retained therein to be circulated into and out of the space and D. pump means a. cooperatively associated with the first and second aperture means of the globe assembly, and b. responsive to a first activation signal for continuously circulating the fluid through the space when activated; and E. drive means a. mounted in the base, b. connected to the movable object for controlling the movement thereof, and c. responsive to a second activation signal for initiating the operation of the drive means;

whereby a crystal ball or globe display system is attained which is capable of providing the visual impression of a display having a movable object contained in a fluid-filled housing.

* * * * *